United States Patent [19]

Alphenaar et al.

[11] Patent Number: 4,913,694

[45] Date of Patent: Apr. 3, 1990

[54] METHOD FOR MANUFACTURING A PICTURE AND/OR TEXT CHANGING SLIDE

[76] Inventors: Gerrit Alphenaar; Reindert Aafjes, both of Industrieweg 13, Wormerveer, Netherlands

[21] Appl. No.: 295,676

[22] Filed: Jan. 11, 1989

[30] Foreign Application Priority Data

Jan. 11, 1988 [NL] Netherlands ..... 8800051

[51] Int. Cl.[4] ..... G09F 7/10; B65H 37/00

[52] U.S. Cl. ..... 493/356; 283/65; 428/7; 40/488; 493/944

[58] Field of Search ..... 493/121, 125, 356, 357, 493/352, 946, 944, 952; 283/65; 428/7, 9; 40/488, 491

[56] References Cited

U.S. PATENT DOCUMENTS 718,305 1/1903 Blanchard ..... 40/488

2,485,806 10/1949 Berg ..... 40/488

3,403,465 10/1968 Lane ..... 40/491

*Primary Examiner*—Frederick R. Schmidt

*Assistant Examiner*—Jack W. Lavinder

*Attorney, Agent, or Firm*—Pollock, Vande Sande and Priddy

[57] ABSTRACT

Method for manufacturing a picture- and/or textchanging slide, in which a piece of planar material is subdivided into three sections, of which two sections provided with changing strips formed by incisions are folded onto each other and are thereafter shifted in position relative to one another to bring the free ends of the changing strips of one section through the incisions of the other section, whereafter two of the sections are folded together into an envelope enclosing the third section and are glued together with a marginal portion of the third section, after which the slide is cut loose from the third section.

3 Claims, 3 Drawing Sheets

METHOD FOR MANUFACTURING A PICTURE AND/OR TEXT CHANGING SLIDE

The invention relates to a method for manufacturing a picture- and/or textchanging slide, in which a piece of planar material with parallel side edges and an upper- and lower edge, is subdivided into at least three sections by folding lines, extending parallel to the side edges, of which two succeeding sections are intended to form the front coversheet and the back coversheet of a flat envelope, which is to enclose the card-like slide made from the third section, and which may be moved to-and-fro between two end positions, and in which a coversheet and the third section each have been provided with a group of adjacent strips, formed by incisions, and extending transverse, resp. more slanting in respect to the slide direction, and which have remained connected to the third section on both its ends, and have remained connected at the coversheet to one of its ends, and have been cut loose on the other end from the coversheet, and in which these free ends are brought through the incisions in the third section onto this third section, such, that by moving the slide between both end positions, the strips of the coversheet and the slide alternately cover each other up.

Such a method is known.

In this known method the free ends of the strips of the coversheet are manually brought through the incisions of the third section, onto this third section, which is a very long-winded and time-consuming work.

The invention intends to obviate this drawback of the known method.

The method according to the invention thereto is characterized, in that the coversheet and the third section, which are folded onto each other around a foldingline, are moved on over a transport-track, more in particular over one or more pushing means placed in the transport-track, in which the free strip-ends of the coversheet and the strip-parts of the third section, located next thereto, or thereon, are pushed or lifted through, more in particular above, the plane of the third section by this pushing mean or these pushing means to come thereupon, after passing the pushing mean or the pushing means, to rest on the parts of the third section outside the strips.

The method according to the invention may be carried out by various devices, known by themselves. Thus, the method according to the invention may be carried out suitably on a so-called folding-boxes-gluing-machine, and which is provided with a transport-track, over which the planar material, with an underlying front coversheet and a third section folded down on it, is moved on over one or more pushing means, and by which the free strip-ends of the front coversheet are lifted onto the third section.

The pushing means may be variously shaped, such as in the form of cams, rolls or steering-wheels, which, on passing the planar material, may act upon the free strip-ends.

In a very favourable embodiment of the method according to the invention, the third section, after the free ends of the strips of the coversheet have been pushed through the plane of the third section under simultaneously pressing through its strips, is moved towards the foldingline between both the coversheets by replacing the foldingline, over which a third section initially had been folded onto the coversheet, by a second foldingline, extending next to the first foldingline, around which the third section finally will be folded onto the coversheet.

In this embodiment of the method according to the invention, the third section is moved over the coversheet, after the free ends of the strips of the coversheet have been brought up onto this upperlying third section, causing the free ends to move further on on the plane of the third section.

After this operation, both the coversheets may be folded around the third section to an envelope and be glued together with the part of the third section located outside the slideportion.

In a favourable embodiment of the invented method, the slide is partly cut loose from the third section with an incision, which ends close to the upper- and/or lower edge of the piece of planar material, and after which later on a strip of the planar material, which contains the bond of the slide with the third section, is cut off along the upper- and/or lower edge of the envelope and the third section therein, so that then the slide will become movable within the envelope.

Before completely cutting loose the slide from the third section, this third section is glued from the second foldingline to the cuttingline, with which the slide has partly been cut loose from the third section, to the coversheet.

The invention will further be explained with reference to the accompanying drawings of an embodiment by way of example.

Figure 1:
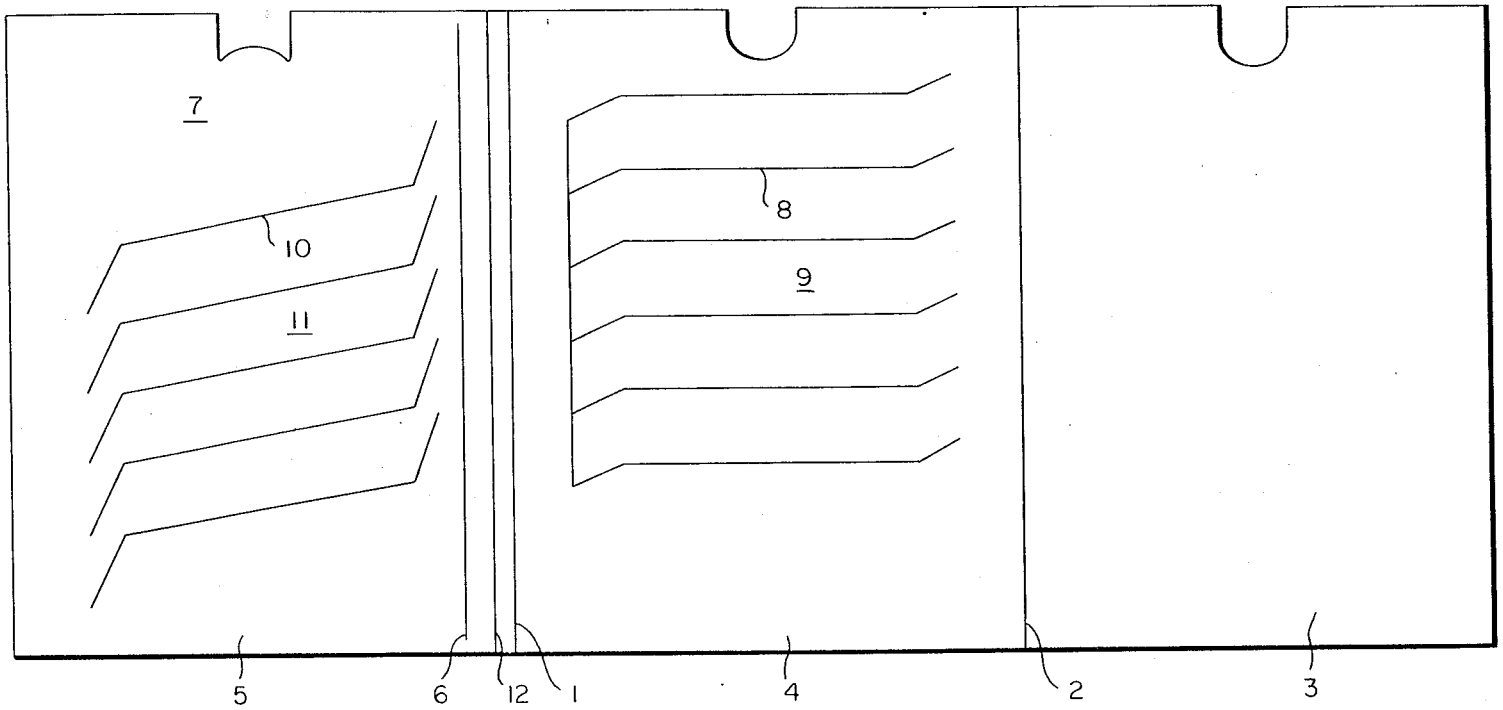
FIGS. 1, 2 and 3 show succeeding stages of process for the manufacturing of a picture- and/or textchanging slide applying the invented method.

As shown in FIG. 1, a piece of planar material with parallel side edges and an upper- and a lower edge, has been subdivided into substantially equal sections 3, 4 and 5, by the foldinglines 1 and 2, and of which the sections 3 and 4, which are connected to each other over the foldingline 2 will form respectively the back coversheet and the front coversheet of the flat envelope, which is to enclose the slide 7, which to be separated from the third section 5 by the cuttingline 6, and which then may be moved between two endpositions within the envelope.

The front coversheet 4 has been provided with strips 9, adjoining each other and extending substantially transverse to the slide direction, and formed by the incisions 8, which, as seen in FIG. 1, have been cut loose at a parting line on the left side of the front coversheet 4 and have remained connected on the right side of it.

The third section 5, connected to the coversheet 4 over the front foldingline 1, has been provided at the slide part 7, which is separated from it by the cuttingline 6, with a group of adjacent strips 11, extending more slantingly in respect to the slide direction, and formed by the incisions 10, which have remained connected at both of their outer-ends to the slide part 7.

Next to the foldingline 1 of the third section is, at a short distance from it, another foldingline 12, of which the function will yet be explained more closely.

Figure 2:
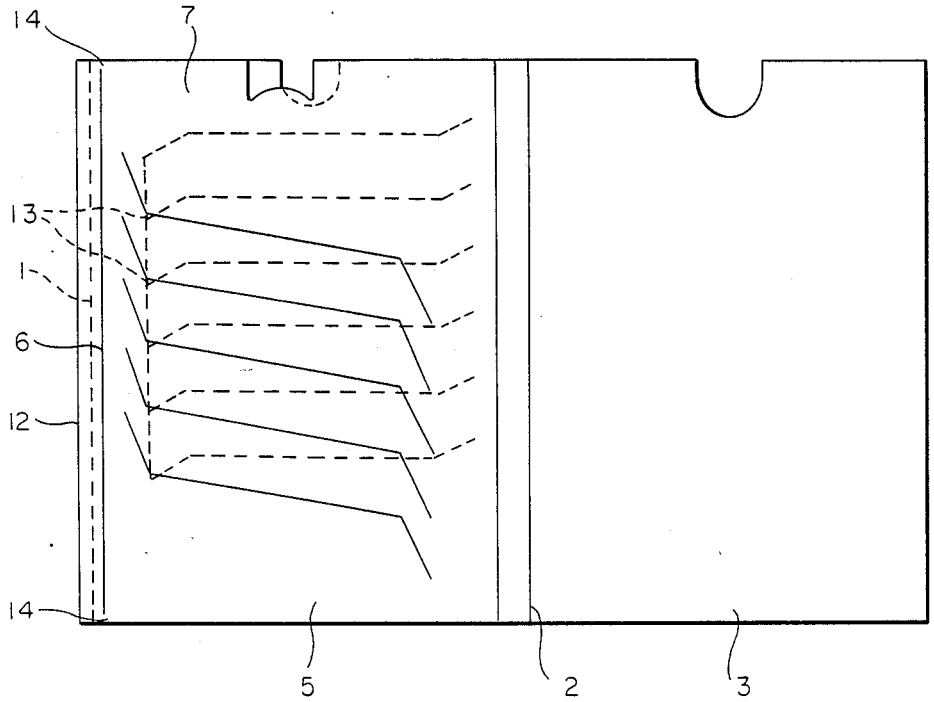

In FIG. 2 the third section 5, which contains the slide 7, has been folded around the foldingline 12 onto the front coversheet 4, and during transportation of the planar material, the underlying free ends of the strips 9 will be pushed upwards by one or more pushing means, such as cams, wheels or rolls, above the plane of the third section 5 outside the strips 11, to come to rest after having passed the pushing means, with the pointed ends 13, on the marginal portions of the slide part 7, outside the incisions 10.

Figure 3:
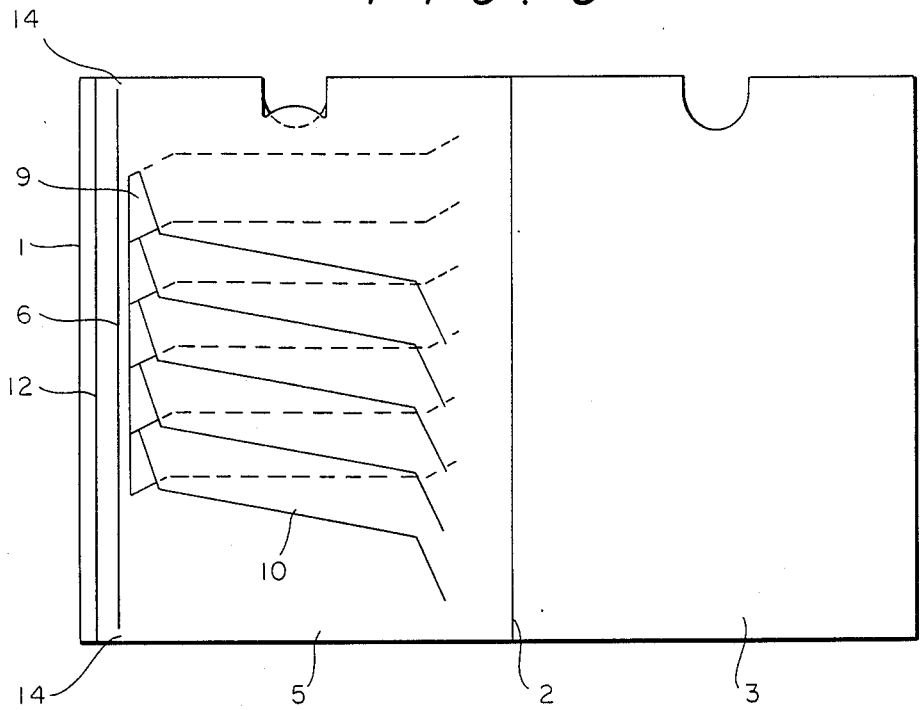

As is shown in FIG. 3, the third section 5 there has been moved to the right towards the foldingline 2 between both the coversheets 3 and 4, by replacing the temporary (first) foldingline 12 by the definite (second) foldingline 1, after which the part of the third section 5, located outside the slide 7, limited by the cuttingline 6, is glued to both coversheets 3 and 4.

Figure 4:
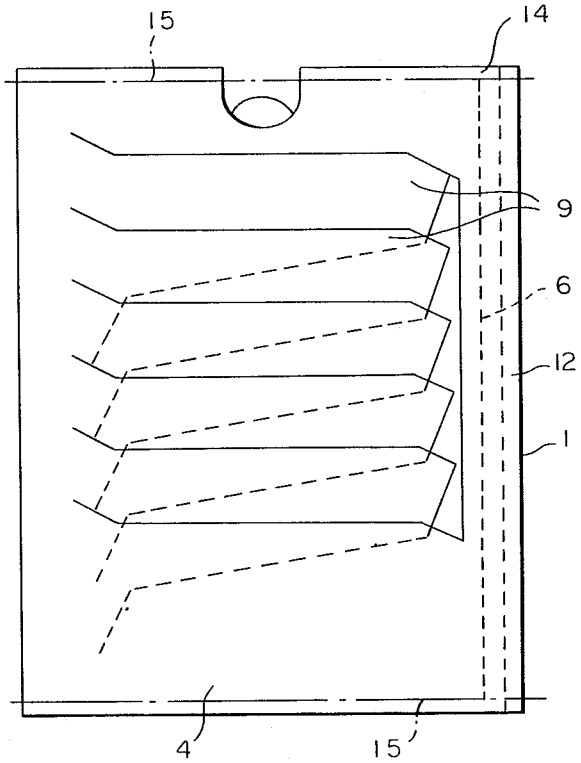

FIG. 4 shows this situation, as seen on the front coversheet 4 and in which the slide is still connected with the third section, because the incision 6, by which the slide has partly been cut loose, does not completely go on as far as the upper- and the lower edge of the piece of planar material, thus leaving bonds 14 on the upper- and the lower edge, by which the slide has remained connected with the third section 5.

Figure 5:
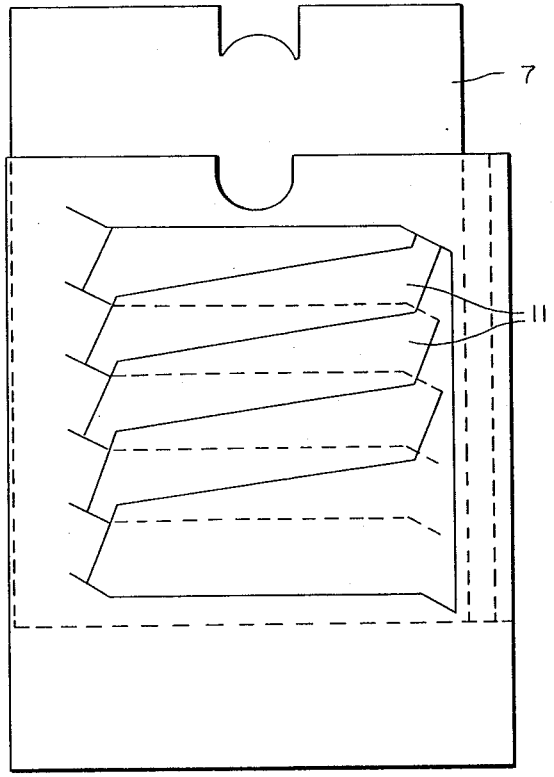
FIGS. 4 and 5 show the finished changing slide in respectively the pushed-in and pushed-out position.

By cutting away the strips of both the coversheets and the third section over the cuttinglines 15, these bonds 14 are also cut away, causing the slide 7 to become movable in the envelope, formed by the coversheets 3 and 4, as shown in FIG. 5.

FIGS. 4 and 5 show the picture- and/or textchanging slide in resp. the pushed-in and the pushed-out position, and which shows, that by alternately moving the slide from one endposition into the other, the strips 9 of the front coversheet and the strips 11 of the slide alternately cover each other up, thus alternately changing the pictures and/or texts on both strips by moving the slide.

We claim:

1. The method of manufacturing a picture and text changing slide comprising the steps of subdividing an elongated piece of rectangular planar material into three sections, said rectangular material having two side edges that are parallel to one another and also having upper and lower edges that are parallel to one another, a first one of said sections being defined between a first one of said side edges and a first fold line that extends between said upper and lower edges in parallel relation to said first side edge, a second one of said sections having substantially the same area as said first section and being defined between said first fold line and a second fold line that extends between said upper and lower edges parallel to and spaced from said first fold line, and a third one of said sections being defined between said second fold line and the second one of said side edges, forming a third fold line in said third section adjacent and parallel to said second fold line between said second fold line and said second side edge, forming a cut line in said third section adjacent and parallel to said third fold line between said third fold line and said second side edge, the opposing ends of said cut line being spaced from said upper and lower edges respectively, forming a group of spaced substantially parallel first incisions in said second section, each of said first incisions extending in a direction transverse to said side edges, severing said second section along a parting line passing through the ends of said first incisions closest to said second fold line whereby said parting line and said first incisions define a group of first elongated strips that are integral with said second section at the end of each strip closest to said first fold line and have free ends at the end of each strip closest to said second fold line, forming another group of spaced substantially parallel second incisions in said third section, each of said second incisions extending in a direction transverse to said side edges and being angularly inclined relative to the directions of extension of said first incisions, the portions of said third section between said second incisions defining a group of second elongated strips each of which has opposing ends integral with said third section, lifting the free ends of said first strips away from the plane of said second section and folding said third section onto said second section about said third fold line to insert said third section beneath said lifted first strips thereby to superpose said third section on said second section with the free end of each of said first strips being positioned adjacent to an edge of one of said second strips, refolding said third section relative to said second section about said second fold line to shift the position of said third section toward said first fold line thereby to push the free end of each of said first strips under one of said second strips, folding said first section about said first fold line onto the superposed second and third sections, attaching said first and second sections to one another adjacent said second fold line and outward of said cut line in said third section, and thereafter cutting away portions of said superposed first, second and third sections along lines that are generally parallel to said upper and lower edges and that intersect said cut line adjacent the opposing ends of said cut line to free said third section for movement between said first and second sections in a direction transverse to said upper and lower edges.

2. The method of claim 1 wherein each of said first incisions extends in a direction generally parallel to said upper and lower edges, a portion of each of said first incisions closest to said second fold line being inclined downwardly toward said lower edge whereby each of said first strips has a point that is defined by said downwardly inclined portions of said first incisions.

3. The method of claim 1 wherein said attaching step is effected by gluing.

* * * * *